US009498813B2

(12) United States Patent
Kim

(10) Patent No.: US 9,498,813 B2
(45) Date of Patent: Nov. 22, 2016

(54) MULTIPOINT STRETCH FORMING APPARATUS ENABLING INDIVIDUAL CLAMPING CONTROL FOR MANUFACTURING A CURVED PANEL

(71) Applicant: STEEL FLOWER CO., LTD., Busan (KR)

(72) Inventor: Byeong Kwen Kim, Busan (KR)

(73) Assignee: STEEL FLOWER CO., LTD., Busan (KR)

( * ) Notice: Subject to any disclaimer, the term of this patent is extended or adjusted under 35 U.S.C. 154(b) by 0 days.

(21) Appl. No.: 14/699,693

(22) Filed: Apr. 29, 2015

(65) Prior Publication Data

US 2016/0167099 A1 Jun. 16, 2016

(30) Foreign Application Priority Data

Dec. 12, 2014 (KR) ..... 10-2014-0179064

(51) Int. Cl.
*B21D 25/02* (2006.01)

(52) U.S. Cl.
CPC ..... *B21D 25/02* (2013.01)

(58) Field of Classification Search
CPC ..... B21D 11/02; B21D 25/00; B21D 25/02; B21D 25/04
See application file for complete search history.

(56) References Cited

U.S. PATENT DOCUMENTS

| | | | | |
|---|---|---|---|---|
| 3,459,025 A * | 8/1969 | Bath | B21D 11/02 72/296 |
| 6,272,897 B1 | 8/2001 | Ciranna | |
| 2013/0086966 A1* | 4/2013 | Park | B21D 22/02 72/294 |
| 2014/0096582 A1* | 4/2014 | Buta | B21D 11/02 72/302 |

FOREIGN PATENT DOCUMENTS

| | | | |
|---|---|---|---|
| KR | 10-2006-0104167 | A | 10/2006 |
| KR | 10-2008-0085917 | A | 9/2008 |
| KR | 10-1030226 | B1 | 4/2011 |
| KR | 20-2011-0006710 | U | 7/2011 |
| KR | 10-1301714 | B1 | 8/2013 |

* cited by examiner

*Primary Examiner* — Debra Sullivan
(74) *Attorney, Agent, or Firm* — Novick, Kim & Lee, PLLC; Jae Youn Kim

(57) ABSTRACT

Provided is a multipoint stretch forming apparatus enabling individual clamping control for manufacturing a curved panel, wherein a plurality of stretching units are positioned at both sides at a lower position of a supporting frame in forward and backward directions, and each of the stretching units is independently and individually controlled. Further, since the distance between the right and left stretching units is adjustable in accordance with the size of punch modules and the size of a curved panel to be formed, the precision formation of both wide and narrow curved panels/shapes is possible. Through this technical constitution, an atypical curved panel is formed more efficiently and the loss of panel material is remarkably reduced.

5 Claims, 7 Drawing Sheets

MULTIPOINT STRETCH FORMING APPARATUS ENABLING INDIVIDUAL CLAMPING CONTROL FOR MANUFACTURING A CURVED PANEL

CROSS-REFERENCE TO RELATED APPLICATION

This application claims the benefit of Korean Patent Application No. 10-2014-0179064, filed on Dec. 12, 2014, the disclosure of which is hereby incorporated herein by reference in its entirety.

BACKGROUND OF THE INVENTION

1. Field of the Invention

The present invention relates to a forming apparatus for manufacturing a curved panel by shaping a flat metal sheet to be curved, and more particularly, to a multipoint stretch forming apparatus enabling individual clamping control for manufacturing a curved panel, wherein both ends of a sheet are stretched to match to the shape of a curved panel by using a plurality of clamps each individually controlled.

2. Description of the Related Art

Generally, curved metal panels in various shapes are used for the hull of a ship, the fuselage of an airplane, the exterior panel of a building.

When a press die is used to mass-produce a curved panel in a typical shape which is a fixed curve shape, like a globular shape or an arc shape, it increases the improvement of workability and productivity.

However, in the case of a curved panel in an atypical shape having multi-dimensional curve shapes, it is very difficult to manufacture it using a press die. Further, when the demand for a particular curved panel is low, a production cost is high due to the die expense.

Patent document 1, below, discloses an apparatus for forming components for an airplane. This apparatus comprises: a top punching member positioned to move vertically by a hydraulic and/or pneumatic device; a bottom die having a processing surface with a number of flat sections, a number of protruding sections and a number of groove sections on its upper side, wherein a workpiece to be processed is positioned on the processing surface; and a number of pressing blocks for a secondary process, positioned on the workpiece so as to be positioned at the groove sections of the bottom die.

To form curved panels for an airplane by using a particular die, such as the apparatus for forming components for an airplane of patent document 1, many dies are needed to form the curved panels in various shapes. Accordingly, the apparatus for forming a curved panel like patent document 1 is not proper to form curved panels in a small quantity batch production.

Patent document 2, below, discloses a multipoint variable press-type apparatus for forming a curved panel. This apparatus comprises: a base with a forward and backward guide rail and a right and left guide rail positioned in the horizontal direction; a bottom punch module positioned on the base, with a number of punches to hold and support a curved panel; a top punch module with a number of punches vertically movable by a hydraulic system; a first supporting punch module positioned at one side of the top punch module, with a number of punches vertically movable by a hydraulic system; and second supporting punch modules positioned at right and left sides of the bottom punch module, with a number of punches vertically movable by a hydraulic system.

Patent document 3, below, discloses a multipoint stretch-type apparatus for forming a shape steel with a curved surface. This apparatus comprises: a stretching section applying tension in the state that both ends of the steel to be shaped are supported by clamps; a formation molding section applying a shear force to the steel under the stretching section; and a controlling section forming a curved surface of curvature being set at a yield point of the steel, by connectively controlling the stretching section and the formation molding section.

Patent document 4, below, discloses a method for manufacturing a panel having a multi-dimensionally curved surface. In this patent document, top and bottom dies are variably symmetrically set as a specific shape of a particular multi-dimensionally curved surface, using a number of multipoint molding pins. In the state that a metal sheet to form the multi-dimensionally curved surface is secured on the top surface of the bottom die forming the specific shape of the multi-dimensionally curved surface, a number of stretch forming apparatuses pull both ends of the metal sheet with a force exceeding a plastic point and a yield point of the metal sheet, to primarily form the multi-dimensionally curved surface in the same shape formed on the top surface of the bottom die. Then, the top die moves down to press the metal sheet stretched in the shape formed on the top die as the shape is.

All techniques disclosed in patent documents 2 through 4 are to efficiently form an atypical shape steel or atypically curved panel in small quantity, by using variable dies.

Patent document 5, below, discloses an elongating, forming and processing machine and method and patent document 6 discloses an apparatus and method for forming panels into complex curved shapes.

The apparatus disclosed in patent document 6, below, comprises a variable displacement tension bar including a number of pull tabs and enabling each pull tab to be independently controlled.

RELATED ART DOCUMENT

Patent Document (Patent Document 1) Korean Patent Published Application No. 10-2006-0104167 (laid-open on Oct. 9, 2006)

(Patent Document 2) Korean U.M. Published Application No. 20-2011-0006710 (laid-open on Jul. 6, 2011)

(Patent Document 3) Korean Patent Publication No. 10-1301714 (published on Aug. 30, 2013)

(Patent Document 4) Korean Patent Publication No. 10-1030226 (published on Apr. 13, 2011)

(Patent Document 5) Korean Patent Published Application No. 10-2008-0085917 (laid-open on Sep. 24, 2008)

(Patent Document 6) U.S. Pat. No. 6,272,897 (published on Aug. 14, 2001)

However, since the multipoint variable press-type apparatus for forming a curved panel disclosed in patent document 2 simply presses a material sheet positioned on a bottom die, using a top die, formability is less than the press equipment using the particular die like patent document 1. Therefore, a post-process is required and it is difficult to form a curved panel having a complicated shape.

Further, the multipoint stretch-type apparatus for forming a shape steel having a curved surface in patent document 3 is to curve the shape steel in a pole or tube shape. Therefore, it cannot form a curved panel being atypically curved.

Further, in the multipoint stretch forming apparatus disclosed in relation to the method for manufacturing a panel having a multi-dimensionally curved surface, each part of both ends of a sheet is stretched by uniform pressure. Therefore, precise formation is difficult and the loss factor of material is high.

Further, in the apparatuses for forming panels into complex curved shapes disclosed in patent documents 5 and 6, it is impossible to adjust the distance between the stretching units, based on the size of a curved panel to be formed or the size of a punch module.

SUMMARY OF THE INVENTION

Therefore, it is an object of the present invention to solve the above problems and to provide a multipoint stretch forming apparatus enabling individual clamping control for manufacturing a curved panel, to more precisely and promptly form an atypical curved panel by stretching each part of both ends of an original panel by using each different pressure based on the shape of a curve to be formed.

It is another object of the present invention to provide a multipoint stretch forming apparatus enabling individual clamping control for manufacturing a curved panel, to lower the loss factor of material.

It is another object of the present invention to provide a multipoint stretch forming apparatus enabling individual clamping control for manufacturing a curved panel, to adjust the distance between stretching units based on the size of a curved panel or the size of a punch module.

In accordance with an embodiment of the present invention, there is provided a multipoint stretch forming apparatus enabling individual clamping control for manufacturing a curved panel, comprising: a supporting frame to support a bottom punch module, stretching units and a top punch module; the bottom punch module positioned in the center at a lower position of the supporting frame; a plurality of the stretching units positioned to be seriately arranged at both sides at the lower position of the supporting frame in forward and backward directions; the top punch module positioned in the center at an upper position of the supporting frame, to be vertically movable; a control unit to control the operation of the bottom punch module, the stretching units and the top punch module; a fixed casing fixedly positioned at one side at the lower position of the supporting frame, to support the stretching units positioned at the one side of the supporting frame; a movable casing positioned at the other side at the lower position of the supporting frame, to be movable in right and left directions and to support the stretching units positioned at the other side of the supporting frame; the moving cylinder positioned at the supporting frame between the fixed casing and the movable casing, to move the movable casing in the right and left directions; and a guide positioned between the fixed casing and the movable casing, to guide the movement of the movable casing in the right and left directions, wherein each of the stretching units is independently and individually controlled by the control unit so that each part of an original panel sheet C is stretched by a different pressure in accordance with a curve shape, and the moving cylinder is operated to adjust the distance between the right and left stretching units in accordance with the size of the bottom punch module and top punch module and the size of a curved panel C to be formed.

Preferably, the supporting frame may comprise: a horizontal supporting element to support the bottom punch module and the stretching units; and a vertical supporting element positioned in the middle of the horizontal supporting element, to support the vertical movement of the top punch module.

Preferably, the bottom punch module may comprise: a support block supported to the supporting frame; and a number of punches seriately arranged in forward and backward and right and left directions on the support block, wherein each of the punches of the bottom punch module is positioned on the support block so as to be movable vertically and is independently moved vertically by a lift actuator operated by a control signal of the control unit.

Preferably, each of the stretching units may comprise: a clamp including a receiving groove positioned inside and a clamping cylinder positioned above; a connecting member to connect the clamp and a stretching cylinder; and the stretching cylinder including a body connected to the supporting frame and an operating plunger connected to the connecting member by a hinge, to stretch the original panel sheet A clamped to the clamp by the control signal of the control unit.

Preferably, the top punch module may comprise: a support block supported to the supporting frame, to be movable vertically; a number of punches seriately arranged in forward and backward and right and left directions under the support block; and a lift cylinder positioned at the supporting frame and connected to the support block, wherein each of the punches of the top punch module is positioned on the support block so as to be movable vertically and is independently moved vertically by a lift actuator operated by a control signal of the control unit.

Preferably, the guide may comprise: a fixed sleeve fixedly positioned at the fixed casing; a movable sleeve fixedly positioned at the movable casing; and a guide shaft with one end fixed to the fixed sleeve and the other end passing through the movable sleeve.

BRIEF DESCRIPTION OF THE DRAWINGS

The above and other features and advantages of the present invention will become more apparent to those of ordinary skill in the art by describing in detail the preferred embodiments thereof with reference to the attached drawings in which.

DESCRIPTION OF NUMBERS FOR CONSTITUENTS IN DRAWINGS

Figure 1:
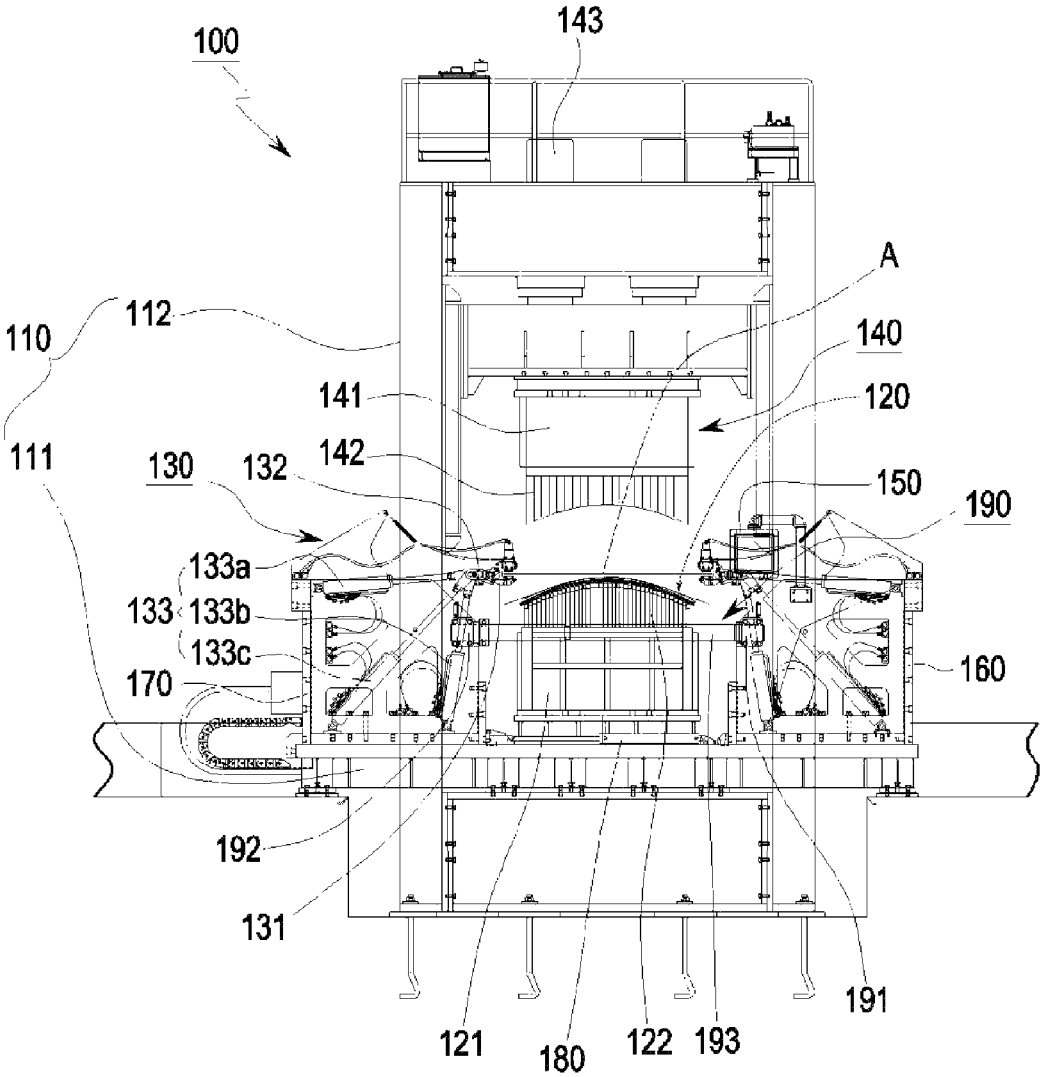
FIG. 1 is a front view of the major parts of a multipoint stretch forming apparatus enabling individual clamping control for manufacturing a curved panel according to an embodiment of the present invention.

100: multipoint stretch forming apparatus enabling individual clamping control for manufacturing a curved panel
110: supporting frame
120: bottom punch module
130: stretching unit
140: top punch module
150: control unit
160: fixed casing
170: movable casing
180: moving cylinder
190: guide

DETAILED DESCRIPTION OF THE PREFERRED EMBODIMENT

The present invention will now be described more fully hereinafter with reference to the accompanying drawings, in which the preferred embodiments of the invention are shown so that those of ordinary skill in the art can easily carry out the present invention.

It should be understood that, the terms of directional natures, "upward", "downward", "forward", "backward", etc., are defined based on the states illustrated in the drawings.

Figure 2:
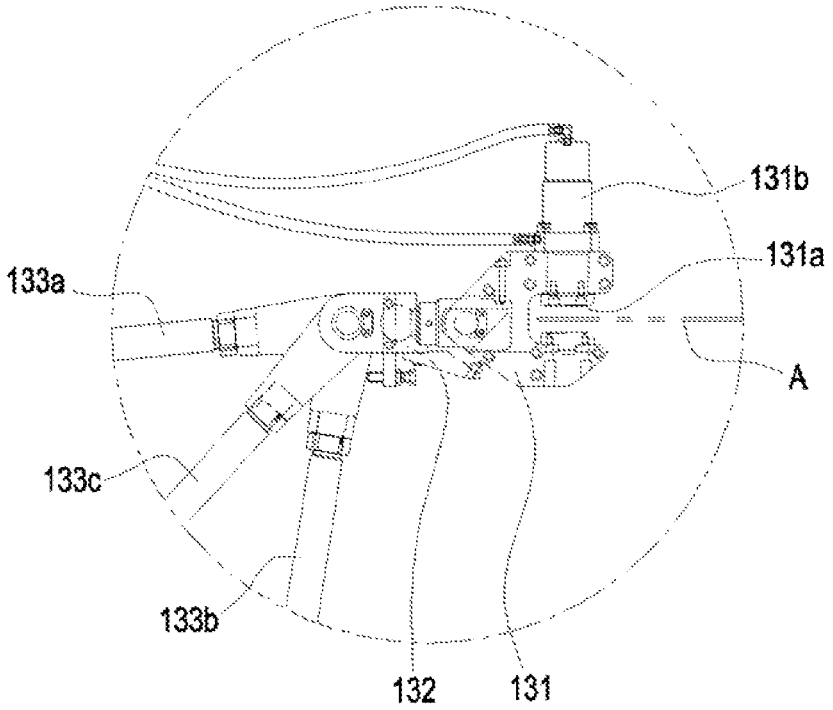
FIG. 2 is an enlarged front view of the major parts of a stretching unit of the multipoint stretch forming apparatus enabling individual clamping control for manufacturing a curved panel according to the embodiment of the present invention.

FIG. 1 is a front view of the major parts of a multipoint stretch forming apparatus enabling individual clamping control for manufacturing a curved panel according to an embodiment of the present invention, and FIG. 2 is an enlarged front view of the major parts of a stretching unit of the multipoint stretch forming apparatus enabling individual clamping control for manufacturing a curved panel according to the embodiment of the present invention.

Figure 3:
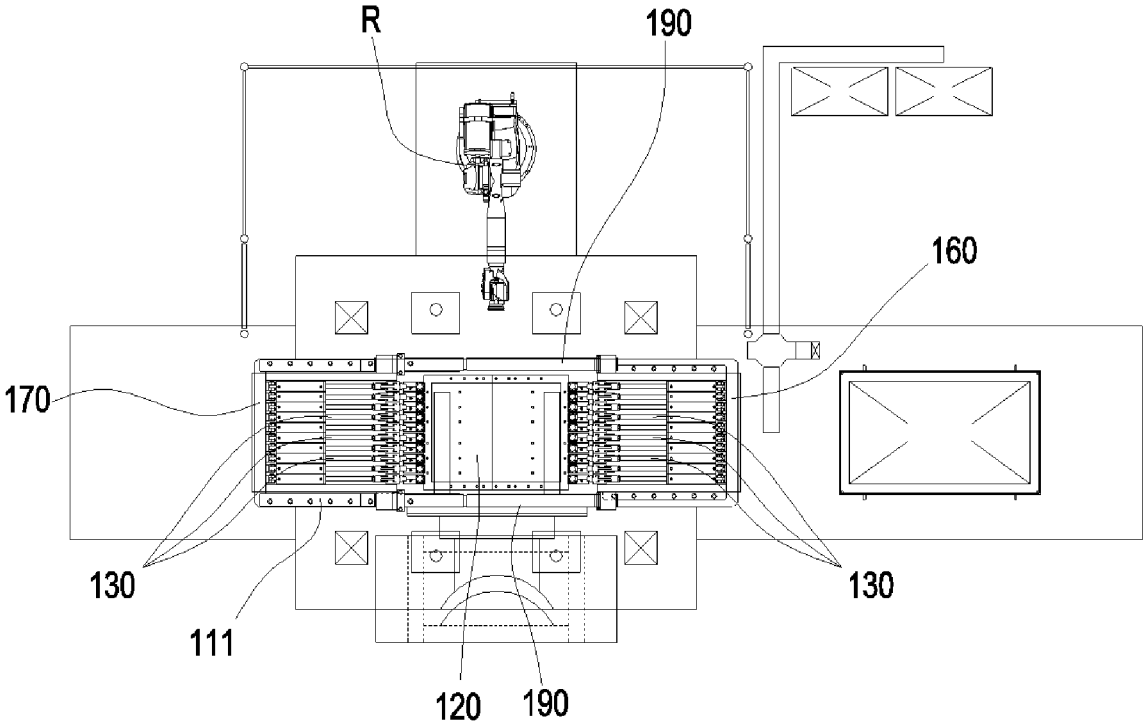
FIG. 3 is a plan view of the major parts of the multipoint stretch forming apparatus enabling individual clamping control for manufacturing a curved panel according to the embodiment of the present invention.
Figure 4:
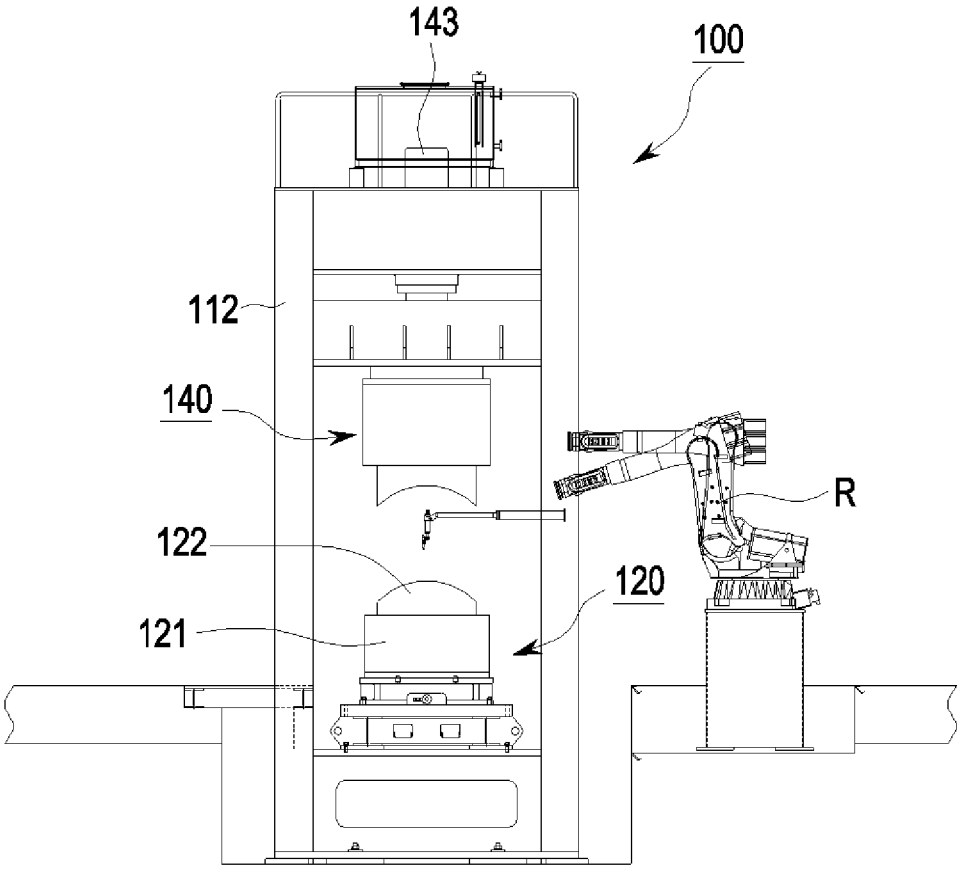
FIG. 4 is a side view of the major parts of the multipoint stretch forming apparatus enabling individual clamping control for manufacturing a curved panel according to the embodiment of the present invention.

FIG. 3 is a plan view of the major parts of the multipoint stretch forming apparatus enabling individual clamping control for manufacturing a curved panel according to the embodiment of the present invention, and FIG. 4 is a side view of the major parts of the multipoint stretch forming apparatus enabling individual clamping control for manufacturing a curved panel according to the embodiment of the present invention.

A multipoint stretch forming apparatus 100 enabling individual clamping control for manufacturing a curved panel according to a preferred embodiment of the present invention comprises: a supporting frame 110, a bottom punch module 120, a stretching unit 130, an top punch module 140, a control unit 150, a fixed casing 160, an movable casing 170, a moving cylinder 180 and a guide 190.

The supporting frame 110 supports the bottom punch module 120, the stretching unit 130 and the top punch module 140.

The supporting frame 110 includes a horizontal supporting element 111 to support the bottom punch module 120 and the stretching unit 130, and a vertical supporting element 112 positioned in the middle of the horizontal supporting element 111, supporting the vertical movement of the top punch module 140.

In the bottom punch module 120, an original panel sheet A is to be formed into a curved panel C. The bottom punch module 120 is positioned at the middle on the horizontal supporting element 111 of the supporting frame 110.

The bottom punch module 120 includes a support block 121 supported by the supporting frame 110, and a number of punches 122 seriately arranged on the support block 121 in the forward and backward and right and left directions.

Each punch 122 of the bottom punch module 120 is positioned at the support block 121 to be vertically movable and independently moves vertically by an lift actuator (not shown) operated through a control signal of the control unit 150.

The stretching unit 130 is to stretch both ends of the original panel sheet A positioned on the bottom punch module 120 by clamping. The stretching unit 130 is positioned at both sides on the vertical supporting element 111 of the supporting frame 110.

The stretching unit 130 includes a clamp 131, a connecting member 132 and a stretching cylinder 133.

The clamp 131 to clamp the original panel sheet A includes a receiving groove 131*a* positioned inside and a clamping cylinder 131*b* positioned above.

The connecting member 131 is to connect the clamp 131 and the stretching cylinder 133.

The stretching cylinder 133 is to stretch the original panel sheet A clamped by the clamp 131 based on a control signal of the control unit 150. A body of the stretching cylinder 133 is connected to the supporting frame 110 by a hinge and an operating plunger is connected to the connecting member 132 by a hinge.

The stretching cylinder 133 includes a first stretching cylinder 133*a* positioned at a titling angle which is close to the horizontal, a second stretching cylinder 133*b* positioned at a tilting angle which is close to the vertical, and a third stretching cylinder 133*c* positioned at a tilting angle which is the middle between the tilting angle of the first stretching cylinder 133*a* and the tilting angle of the second stretching cylinder 133*b*.

In the multipoint stretch forming apparatus 100 enabling individual clamping control for manufacturing a curved panel according to the embodiment of the present invention, a plurality of the stretching units 130 are positioned to be seriately arranged in the forward and backward directions and the stretching cylinder 133 of each stretching unit 130 is independently and individually controlled.

That is, in the multipoint stretch forming apparatus 100 enabling individual clamping control for manufacturing a curved panel according to the embodiment of the present invention, the plurality of the stretching units 130 stretch the original panel sheet A by using different stretching pressure, in accordance with the shape of a curved panel C to be formed.

The top punch module 140 is positioned at the vertical supporting element 112 of the supporting frame 110, to be vertically movable.

The top punch module 140 includes a support block 141 supported by the supporting frame 110 to be vertically movably; a number of punches 142 seriately arranged under the support block 141 in the forward and backward right and left directions; and a lift cylinder 143 positioned on the vertical supporting element 112 of the supporting frame 110 and connected to the support block 141.

Each punch 142 of the top punch module 140 is positioned at the support block 141 to be vertically movable and independently moves vertically by a lift actuator (not shown) operated through the control signal of the control unit 150.

The control unit 150 controls the operations of the lift actuator of each of the top punch module 120 and the bottom punch module 140, the stretching cylinder 133 of the stretching unit 130, the lift cylinder 143 of the top punch module 140 and the moving cylinder 180. The control unit 150 is positioned in front of the vertical supporting element 112 of the supporting frame 110.

The control unit 150 adjusts the positions where the punches 122, 142 of the bottom punch module 120 and top punch module 140 move vertically, based on the information of the curved panel being input, making the shape of the curved panel to be formed by the top surface of the bottom punch module 120 and the bottom surface of the top punch module 140.

The fixed casing 160 is open at a top and left side. The fixed casing 160 is to support each stretching unit 130 stretching a right side of the original panel sheet A.

The fixed casing 160 is fixedly positioned on the left side of the horizontal supporting element 111 of the supporting frame 110.

The movable casing 170 is open at a top and right side. The movable casing 170 is to support each stretching unit 130 stretching a left side of the original panel sheet A.

The movable casing 170 is positioned on the right side of the horizontal supporting element 111 of the supporting frame 110, to be movable in the right and left directions.

The moving cylinder 180 is to move the movable casing 170 and the stretching units 130 supported by the movable casing 170. The moving cylinder 180 is positioned on the horizontal supporting element 111 of the supporting frame 110 between the fixed casing 160 and the movable case 170.

A body of the moving cylinder 180 is fixedly positioned on the horizontal supporting element 111 of the supporting frame 110 and an operating plunger is connected to the right side of the movable casing 170.

Accordingly, when the operating plunger of the moving cylinder 180 is operated to be received toward the body, the movable casing 170 connected to the operating plunger and each stretching unit 130 supported by the movable casing 170 move towards the fixed casing 160, so that the distance between the fixed casing 160 and the movable casing 170 and the distance between the right and left stretching units 130 are shortened.

On the contrary to this, when the operating plunger of the moving cylinder 180 is operated to be withdrawn from the body, the movable casing 170 and each stretching unit 130 supported by the movable casing 170 move in the opposite directions, so that the distance between the fixed casing 160 and the movable casing 170 and the distance between the right and left stretching units 130 are increased.

In the multipoint stretch forming apparatus 100 enabling individual clamping control for manufacturing a curved panel according to the embodiment of the present invention, a pair of the moving cylinder 180 is positioned in the front and back on the horizontal supporting element 111 of the supporting frame 110 between the fixed casing 160 and the movable casing 170. However, the number and shape of the moving cylinders 180 to be installed may be modified within the range to be predicable.

The guide 190 is to guide the right and left movement of the movable casing 170 and the stretching unit 130 supported by the movable casing 170. The guide 190 is positioned between the fixed casing 160 and the movable casing 170.

The guide 190 includes a fixed sleeve 191 fixedly positioned at the fixed casing 160; a movable sleeve 192 fixedly positioned at the movable casing 170; and a guide shaft 193 with one end fixed to the fixed sleeve 191 and the other end passing through the movable sleeve 192.

In the drawings, reference mark R not explained indicates a loading and unloading robot.

In the multipoint stretch forming apparatus 100 enabling individual clamping control for manufacturing a curved panel according to the embodiment of the present invention, after a primarily formation is performed by stretching the original panel sheet A positioned on the bottom punch module 120 by using the plurality of the stretching units 130, a curved panel which is primarily formed is pressurized by using the top punch module 140, to form the curve plate C.

Prior to the process of forming the curved panel, the control unit 150 adjusts each of the punches 122, 142 to the shape of the curved panel C to be formed, by operating the lift actuators of the bottom punch module 120 and top punch module 140, based on the information of the curved panel being previously input.

Further, in the process of stretching the original panel sheet A positioned on the bottom punch module 120, the control unit 150 independently and individually controls the operation of the stretching cylinder 133 of each stretching unit 130, according to the shape of the curved panel C, so that the original panel sheet A is formed to the curved panel C more precisely and promptly.

Figure 5:
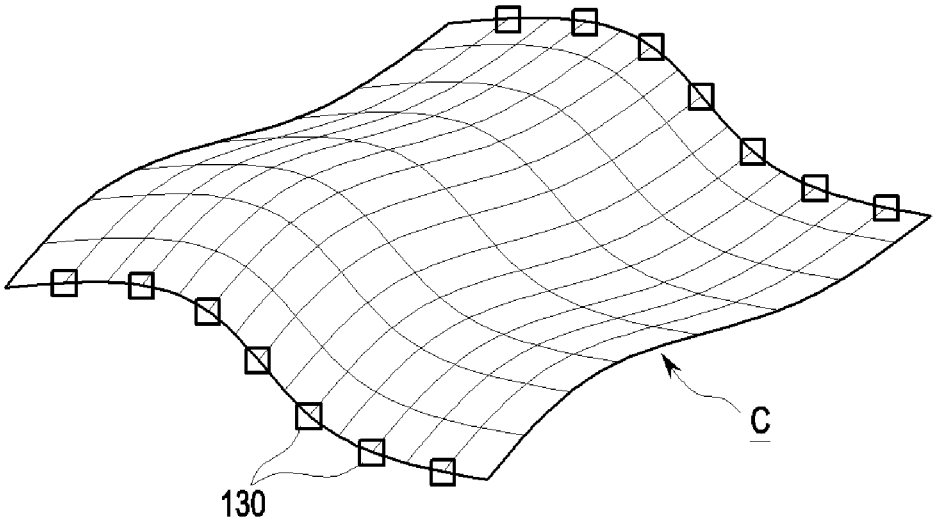
FIG. 5 is a perspective view of an atypically curved panel formed by the major parts of the multipoint stretch forming apparatus enabling individual clamping control for manufacturing a curved panel according to the embodiment of the present invention.

FIG. 5 is a perspective view of an atypical curved panel formed by the major parts of the multipoint stretch forming apparatus enabling individual clamping control for manufacturing a curved panel according to the embodiment of the present invention.

The atypical curved panel C shown in FIG. 5 is curved in the right and left directions and the upward and downward directions. In the case of forming the atypical curved panel C including the curved parts curved downward in the forward and backward directions as shown in FIG. 5, when the original panel sheet A is stretched, the stretching unit 130 clamping the downwardly curved part, among the plurality of the stretching units 130, is controlled to put the tensile force which is relatively higher than the stretching unit(s) 130 clamping the other part(s).

The outer part of the curved panel C finishing the above stretching formation and the pressing formation by the top punch module 140 is cut based on the dimensions being set, completing the final curved panel. The finished curved panel C is checked for accuracy through a measuring process and then shipped.

In the multipoint stretch forming apparatus 100 enabling individual clamping control for manufacturing a curved panel according to the embodiment of the present invention, the distance between the right and left stretching units 130 is properly adjusted, based on the size of the bottom punch module 120 and top punch module 140 and the size of the curved panel C to be formed.

That is, in the multipoint stretch forming apparatus 100 enabling individual clamping control for manufacturing a curved panel according to the embodiment of the present invention, the movable casing 170 and the stretching unit 130 at one side supported by the movable casing 170 are movable in the right and left directions.

Therefore, since the distance between the right and left stretching units 130 is variably set, the curved panel C in a different size is precisely formed by replacing the bottom punch module 120 and top punch module 140 in a different size.

Figure 6A:
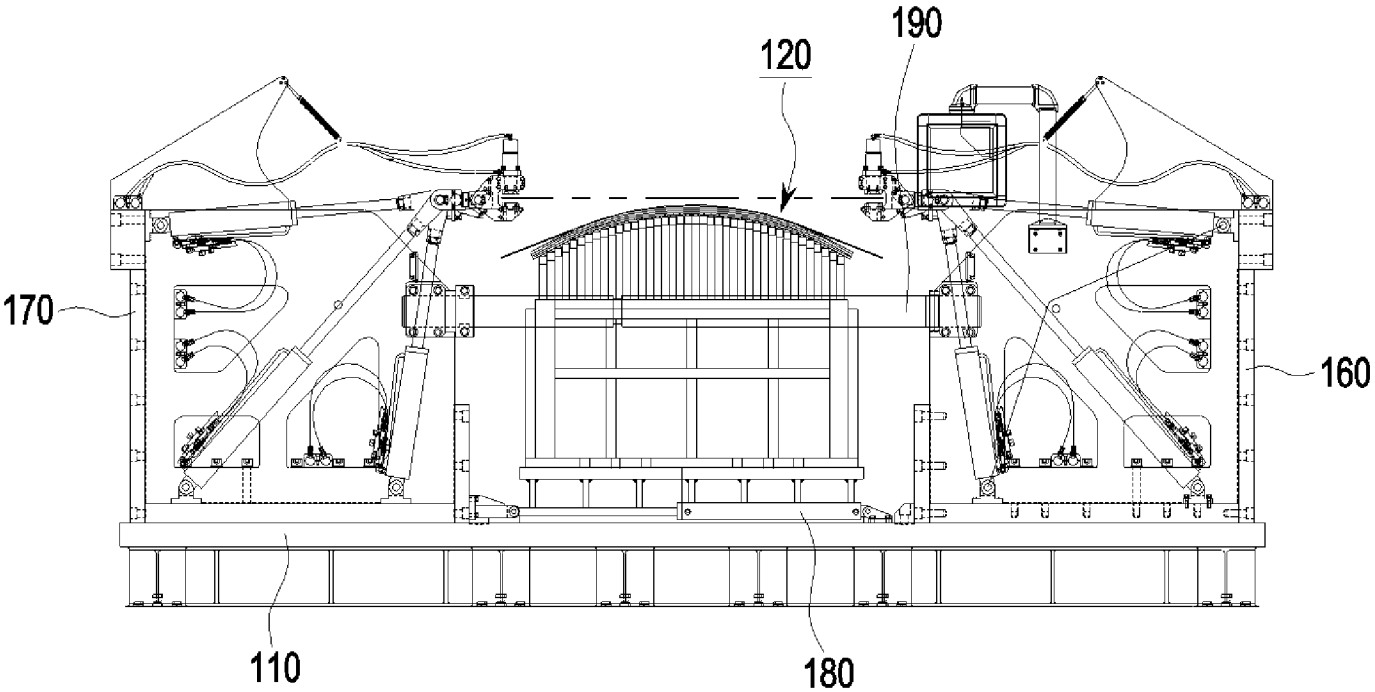
FIGS. 6A and 6B are front views of major parts showing a replacement of a punch module in the multipoint stretch forming apparatus enabling individual clamping control for manufacturing a curved panel according to the embodiment of the present invention.
Figure 6B:
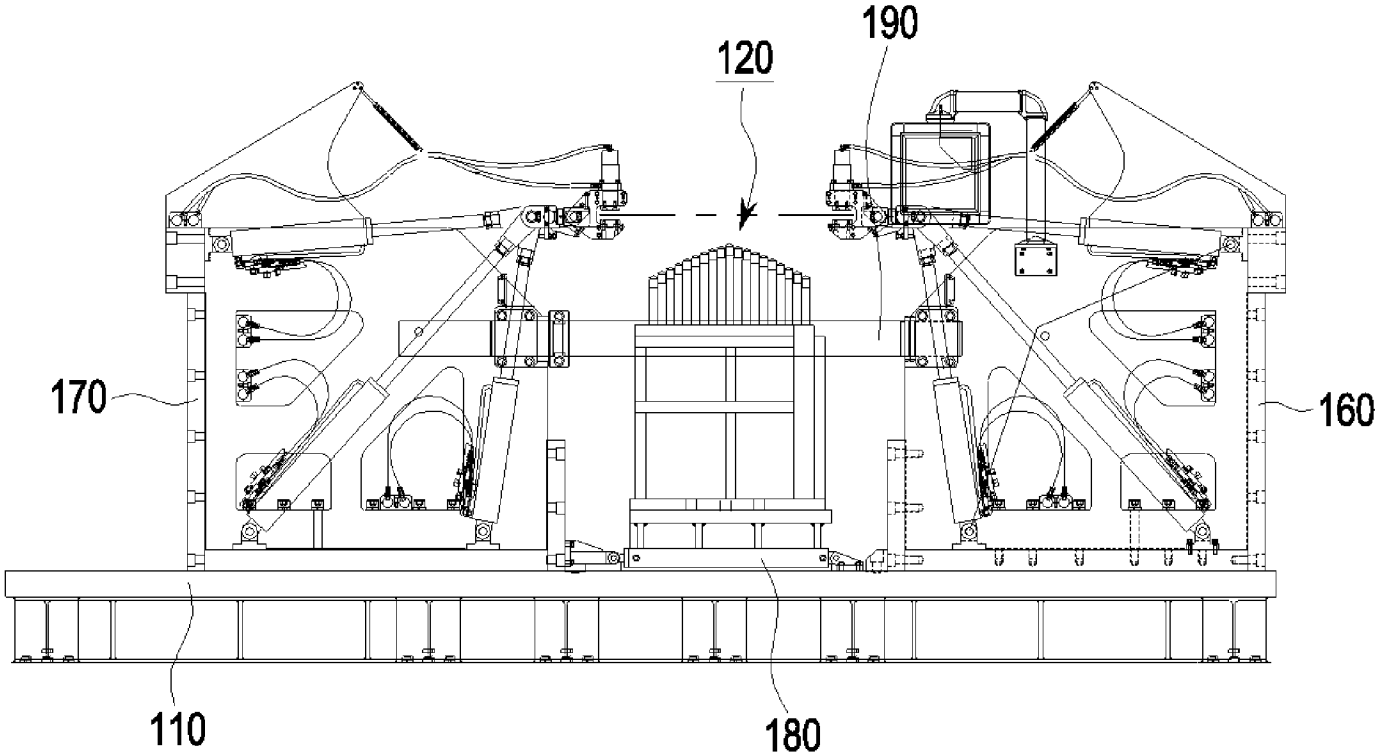

FIGS. 6A and 6B are front views of major parts showing a replacement of a punch module of the multipoint stretch forming apparatus enabling individual clamping control for manufacturing a curved panel according to the embodiment of the present invention.

In the multipoint stretch forming apparatus enabling individual clamping control for manufacturing a curved panel according to the present invention, each part of the original panel sheet is efficiently stretched, based on the curve shape by a plurality of the stretching units which are seriately arranged in forward and backward directions and independently and individually controlled, thereby greatly improving the degree of formation precision and the productivity.

Further, according to the multipoint stretch forming apparatus enabling individual clamping control for manufacturing a curved panel of the present invention, the loss factor of the material is remarkably lowered, thereby increasing the reduction of production cost.

Further, it is possible to precisely set the distance between the left and right stretching units based on the right and left lengths of the punching modules and curved panel to be formed and it is possible to freely replace the punching modules in various sizes for use.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

What is claimed is:

1. A multipoint stretch forming apparatus enabling individual clamping control for manufacturing a curved panel, comprising:

a supporting frame;

a bottom punch module supported by the supporting frame and positioned at a lower portion of the supporting frame;

two sets of stretching devices supported by the supporting frame and respectively arranged at both sides at the lower portion of the supporting frame, wherein each set has a plurality of stretching units arranged seriately;

a top punch module supported by the supporting frame and positioned at an upper portion of the supporting frame to be vertically movable;

a fixed casing fixedly positioned at one side of the both sides at the lower portion of the supporting frame to support one of the two sets of the stretching devices positioned at the one side of the supporting frame;

a movable casing positioned at the other side of the both sides at the lower portion of the supporting frame to be movable in the both side directions and to support the other of the two sets of stretching devices positioned at the other side of the supporting frame;

a moving cylinder positioned at the supporting frame between the fixed casing and the movable casing to move the movable casing in the both side directions;

a control unit to control the bottom punch module, the plurality of the stretching units, the top punch module and the moving cylinder; and a guide positioned between the fixed casing and the movable casing to guide the movable casing in the both side directions, wherein each of the plurality of stretching units is independently and individually controlled by the control unit so that each part of a panel sheet is stretched by a different pressure in accordance with a curved shape of the curved panel, and the moving cylinder is operated to adjust a distance between the two sets of stretching devices in accordance with sizes of the bottom punch module and top punch module and a size of the curved panel to be formed, and wherein each of the plurality of stretching units comprises:

a clamp including a receiving groove positioned inside and a clamping cylinder positioned above the receiving groove, a stretching cylinder unit including a first stretching cylinder, a second stretching cylinder, and a third stretching cylinder disposed between the first and the second stretching cylinders, and a connecting member to connect the clamp and the stretching cylinder unit, wherein each of the first, second and third stretching cylinders include a body connected to the supporting frame and an operating plunger connected to the connecting member by a hinge, to stretch the panel sheet clamped in the clamp.

2. The multipoint stretch forming apparatus of claim 1, wherein the supporting frame comprises:

a horizontal supporting element to support the bottom punch module and the two sets of stretching device; and a vertical supporting element positioned in a middle of the horizontal supporting element to support the top punch module.

3. The multipoint stretch forming apparatus of claim 1, wherein the bottom punch module comprises:

a support block supported by the supporting frame; and a number of punches seriately arranged in the both side directions and forward and backward directions perpendicular to the both side directions on the support block, wherein each of the punches of the bottom punch module is positioned on the support block so as to be vertically and independently movable by a lift actuator operated by the control unit.

4. The multipoint stretch forming apparatus of claim 1, wherein the top punch module comprises:

a support block supported by the supporting frame to be vertically movable;

a number of punches seriately arranged in the both side directions and forward and backward directions perpendicular to the both side directions under the support block; and a lift cylinder positioned at the supporting frame and connected to the support block, wherein each of the punches of the top punch module is positioned on the support block so as to be vertically and independently movable by a lift actuator operated by the control unit.

5. The multipoint stretch forming apparatus of claim 1, wherein the guide comprises:

a fixed sleeve fixedly positioned at the fixed casing;

a movable sleeve fixedly positioned at the movable casing; and a guide shaft with one end fixed to the fixed sleeve and the other end passing through the movable sleeve.

* * * * *